United States Patent [19]

Pazeotopoulos

[11] Patent Number: 4,655,375

[45] Date of Patent: Apr. 7, 1987

[54] TIE HOLDER

[76] Inventor: Chris C. Pazeotopoulos, 6306 SW. Capital Hwy., Portland, Oreg. 97201

[21] Appl. No.: 761,474

[22] Filed: Aug. 1, 1985

[51] Int. Cl.[4] ..... A41D 25/04

[52] U.S. Cl. ..... 223/85; 24/49 CF; 206/38; 206/806; 223/DIG. 1

[58] Field of Search ..... 24/49 C, 49 CP, 49 CF, 24/49 P, 49 R, 806, 56, 49 TS; 206/216, 38; 223/85, DIG. 1

[56] References Cited

U.S. PATENT DOCUMENTS

| | | | |
|---|---|---|---|
| 309,659 | 12/1984 | Smith | 24/56 |
| 1,874,853 | 8/1932 | Baer | 24/49 C |
| 3,032,242 | 5/1962 | Roberts | 206/806 X |
| 3,059,298 | 10/1962 | Stenby | 24/49 TS |
| 3,400,434 | 9/1968 | Pazeotopoulos | 24/49 P |
| 3,793,681 | 2/1974 | Casstevens et al. | 24/49 CF X |
| 4,123,824 | 11/1978 | Roberts | 24/49 CP |
| 4,360,106 | 11/1982 | Irvine et al. | 206/806 X |

OTHER PUBLICATIONS

"Hidden Tie Holder", Photographs and Photocopy of Marketing Package, (attached as Exhibit A).

*Primary Examiner*—Werner H. Schroeder
*Assistant Examiner*—Andrew M. Falik
*Attorney, Agent, or Firm*—Kolisch, Hartwell & Dickinson

[57] ABSTRACT

A necktie-securing clamp of flattish construction anchorable to a wearer's shirt button for retaining the folds of a four-in-hand is defined. Included is a flat button-mounting upper portion with a button thread slit and a fold-retaining pin joined to and extending below the upper portion. The pin is insertable into the rear seam of the front fold of the tie and cooperates with the upper portion to form a slit which, in operative position, pinches the front and rear folds. The entire assembly is hidden from view during use by the tie folds thus retained. An embodiment which features the tie holder as part of a tie hanger is also described.

20 Claims, 9 Drawing Figures

TIE HOLDER

BACKGROUND AND SUMMARY OF THE INVENTION

This invention pertains to a necktie holder of the type suitable for securing the folds of a four-in-hand.

With the advent of the four-in-hand in the late 1800s and its subsequent acceptance as a fashionable accessory to formal dress, the problem of dealing with the hanging folds of the necktie emerged. A tie jewelry industry developed to fill this need and for years provided jeweled tie tacks, clips, clamps, bars, chains and the like, offering the wearer a means of securing his necktie folds with a decorative, visible device. These traditional tie accessories were often unsuitable for the wide neckties that became fashionable in the late 1960s. Also, an increasing number of necktie wearers found the traditional means of securing their neckties to be a distraction from the necktie itself, and in some cases, undesirable due to the damage afforded the necktie when they were employed. Eventually, the fashion industry responded by providing neckties with horizontal labels stitched on the lower rear center of the front tie fold, enabling insertion of the rear tie fold through the label to keep the folds of the necktie together. This approach, of course, did not solve the problem of keeping the tie against the shirt front where it belonged. Eventually, some hidden tie holders became available, including one by the present inventor, granted U.S. Pat. No. 3,400,434, issued Sept. 10, 1986.

Nevertheless, prior to the present invention, no single tie holding device provided for all of the following objectives.

A general object of the invention is to provide a means, not visible to the eye, to hold the folds of a four-in-hand snugly against a dress shirt. Another object of the invention is to provide a design that is inherently inexpensive to manufacture and that lends itself to mass production by currently available techniques. A further object of the invention is to provide a tie holder which is simple and easy to attach to a shirt and a four-in-hand, will remain securely in place once thus attached, and will perform its tie holding function without piercing or otherwise damaging the necktie material.

The present invention achieves the above objects as described hereinbelow.

A tie holder made in accordance with the instant invention features a unitary design which can be economically mass-produced by plastic injection molding processes. The convenient size and friction-promoting surfaces of the instant design assist the wearer in mounting the device and installing the folds of a four-in-hand thereto. By means of communicating slits designed into the structure of the instant invention, insertion of the tie holder onto a shirt button and placement of the necktie folds into desired position is facilitated. The tie holder described is designed to be completely hidden, when worn, by the folds of the four-in-hand that it is securing. Inasmuch as the folds are secured by crimping, no puncturing or other damage to the necktie will be caused by the use of a tie holder of the instant design. By means of constrictions, nubs, and notches designed into the shape and surfaces of the tie holder described herein, the likelihood of the tie holder becoming accidentally unfastened from the shirt button or the necktie is minimized.

An alternative embodiment of the tie holder as part of a tie hanger assembly is also described.

Other objects, features, and advantages of the invention will become apparent upon reading the following detailed description in conjunction with the accompanying drawings.

DETAILED DESCRIPTION OF THE PREFERRED EMBODIMENT

Figure 1:
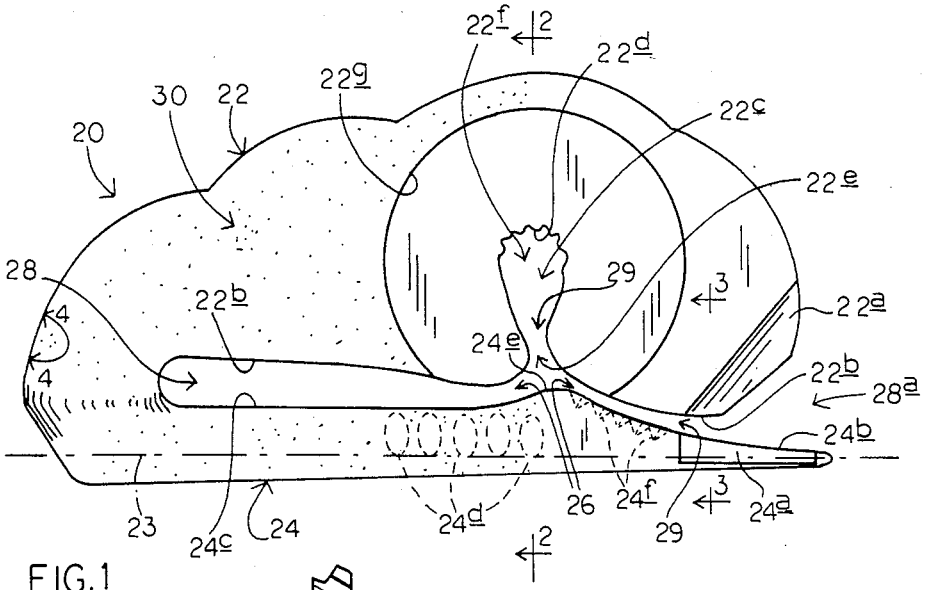
FIG. 1 is a front view of a tie holder in operative position made according to the instant invention.

Referring to the drawings, specifically FIG. 1, a tie holder contemplated by the invention is shown generally at 20. The silhouette of the tie holder is in the general form of the letter C with an arcuate upper portion 22 and a flattened bottom which forms a pin portion 24. Upper portion 22 is generally planar, as particularly shown in FIG. 2, and includes a beveled distal edge **22*a* on its front surface. The upper portion also includes a lower edge 22*b* formed in two sections surrounding a button thread slit 22*c* which extends generally vertically into the upper portion. Thread slit 22*c* opens downwardly through a thread-constricting throat 22*e* and has internal nubs, such as nub 22*d*, extending into a button-thread-accommodating end 22*f*. A generally circular button recess 22*g* is featured in the planar surface of the upper portion and generally surrounds thread-accommodating end 22*f***.

Figure 2:
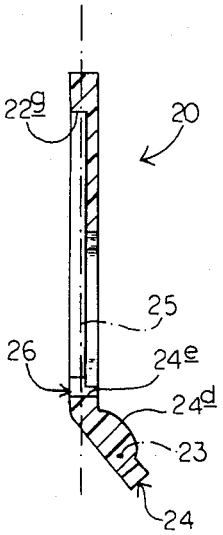
FIG. 2 is a cross-sectional view, taken generally along the line 2—2 in FIG. 1.
Figure 3:
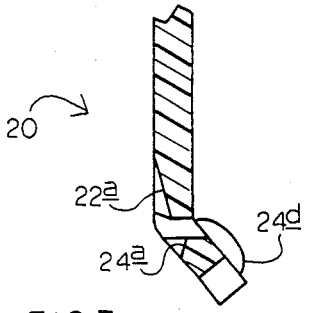
FIG. 3 is an expanded-scale, cross-sectional view, taken generally along the line 3—3 in FIG. 1.

Pin portion 24 is attached at one end below upper portion 22, and extends along a longitudinal axis 23 generally parallel to and slightly rearwardly of a plane 25 of the upper portion as illustrated in the cross-sectional view of FIG. 2. Referring to FIGS. 1 and 3, the distal end of the pin portion includes a taper **24*b* and a bevel 24*a* generally opposite bevel 22*a*. The two bevels 22*a*, 24*a* taper toward each other to form, in combination, a generally lazy-V-shaped button scoop, also referred to as a mouth, to be discussed hereinafter. Pin portion 24 has an upper edge 24*c* adjacent the lower edge of upper portion 22. Upper edge 24*c* and lower edge 22*b* cooperate to form a fold-constricting region 26 on each side of throat 22*e*. A stretch of pin nubs 24*d* is included on the rearward side of the pin portion as shown in FIGS. 1, 2, 3 and 5. Upper edge 24*c* includes a protuberance 24*e* generally opposite and extending toward thread slit 22*c***.

The pin portion and lower edge 22b form a generally-horizontal elongate fold-retaining slit 28 which communicates with the bottom of thread slit 22c. These two slits thus form a generally upside-down T-shape. Upper edge 24c, particularly along protuberance 24e, and lower edge 22b cooperate to form, part of a thread guide slit 29. The thread guide slit thus formed is a generally continuous channel extending from the opening of tie holder 20 into button thread slot 22c.

As previously stated, fold-constricting region 26 extends to either side of thread slit 22c. As shown most clearly in FIG. 5, upper edge 24c includes generally rearwardly facing notches 24f in the section of fold-constricting region 26 nearest the distal end of the pin portion. As seen in FIG. 1 and elsewhere, beveled edges 22a, 24a form a generally lazy-V-shaped mouth 28a at the opening of tie holder 20 at the entrance of fold-retaining slit 28. Here, the term "lazy-V" denotes the general shape of the letter "V" rotated in its plane about 90° so as to appear to be lying on its side.

Figure 4:
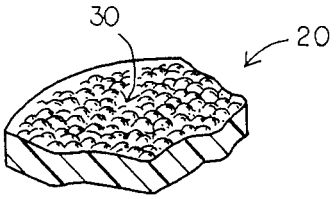
FIG. 4 is a fragmentary, expanded-scale view illustrating surface texture, taken generally along the line 4—4 in FIG. 1.
Figure 5:
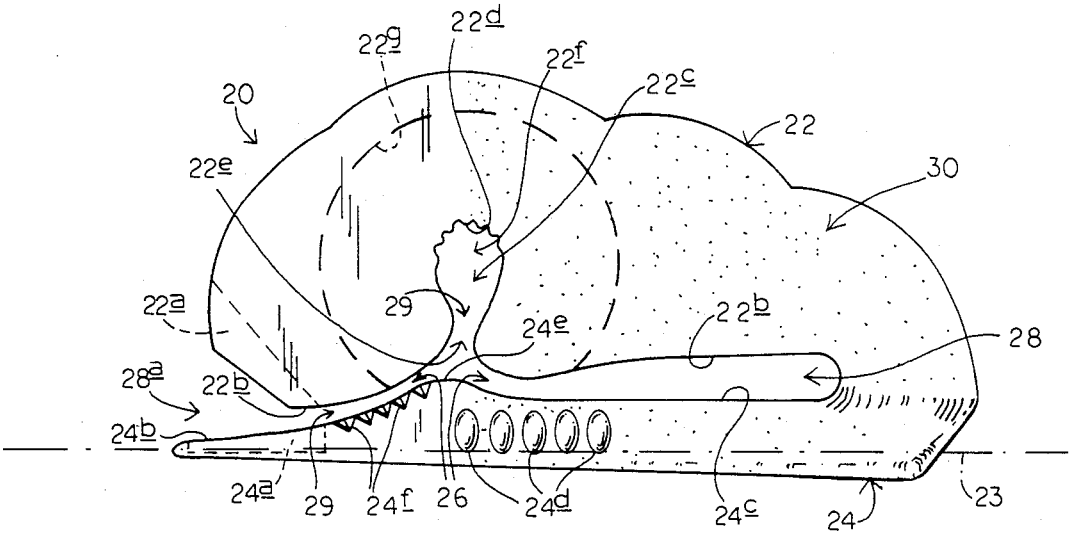
FIG. 5 is a rear view of the tie holder of FIG. 1.

As shown in FIGS. 1, 4 and 5, a textured surface 30 is provided on the front and rear surfaces of the tie holder on the side where pin portion 24 is joined to upper portion 22.

Figure 9:
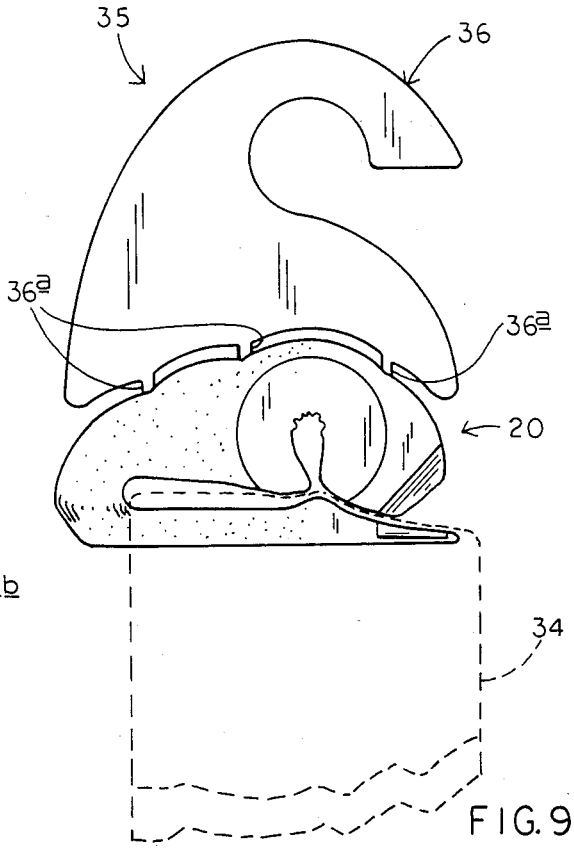
FIG. 9 is a simplified illustration of the tie holder as part of a tie hanger assembly.

FIG. 9 depicts an embodiment of the tie holder as part of a tie hanger 35. Here a hook section 36, also referred to as hanger means, is attached at several points, via joining nubs 36a, to tie holder 20.

OPERATION

Referring to FIGS. 1, 6, 7 and 8, use of the tie holder will now be described.

Figure 7:
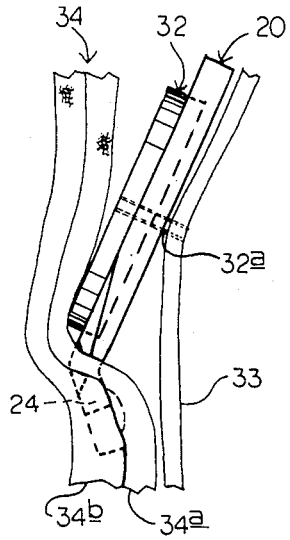
FIG. 7 is a side view of the tie holder in use illustrating the relative positions of a shirt, button, and necktie folds to the tie holder.
Figure 8:
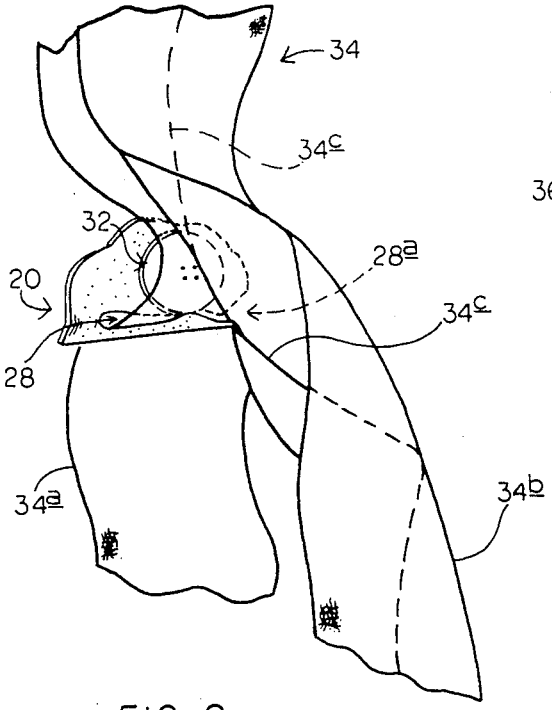
FIG. 8 is a reduced-scale, perspective view of the tie holder showing a rear necktie fold in final position and a front fold positioned with a tie holder pin portion ready for insertion into the front fold seam.

Directing attention initially to FIGS. 1, 7 and 8, the holder is first mounted on a button 32 of a wearer's shirt 33 by inserting button threads 32a into mouth 28a, through the thread guide slit 29, past thread-constricting throat 22e, to thread-accommodating end 22f of the button thread slit. Bevels 22a and 24a assist in thus seating the tie holder by gradually lifting the button away from the shirt as required to permit insertion of the tie holder between the button and the shirt.

Figure 6:
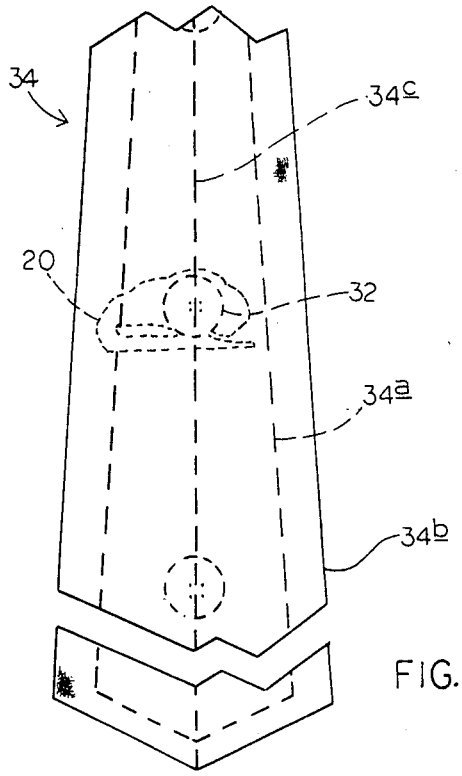
FIG. 6 is a reduced-scale, phantom view of the tie holder in place behind a wearer's necktie.

Once the tie holder is mounted to the shirt, nubs 22d and thread-constricting throat 22e provide traction to the button threads 32a or to the attached shirt to prevent rotational motion of the tie holder and to hold the tie holder in its desired position behind button 32 as shown in FIGS. 6, 7 and 8.

Often, a button is affixed to a shirt so snugly that, when the button is lifted to insert the tie holder, a generally cone-shaped section of the shirt material is drawn by the button threads into the various slits being described. The features of the tie holder are effective in operating on either the button threads or a section of shirt material. References herein to button threads should be understood to include button threads alone or in combination with shirt material, or shirt material alone—depending upon the individual case.

Button 32 also nestles in recess 22g further immobilizing the tie holder with respect to the shirt.

Once the tie holder is mounted on the wearer's shirt, necktie 34 is installed by first inserting rear fold 34a through mouth 28a into fold-retaining slit 28, as shown in FIG. 8. Referring again to FIGS. 1, 7 and 8, fold-constricting region 26, in conjunction with notches 24f and the lower edge of button 32, provides traction to hold the rear fold in place. Protuberance 24e dimples the rear fold toward thread slit 22c providing both additional force to retain the button threads and additional traction to hold the rear fold.

Referring to FIG. 8, front fold 34b is then attached to the tie holder by inserting pin portion 24 into a rear seam 34c of front fold 34b. Taper 24b of the pin portion 24b facilitates this insertion. Necktie folds 34a and 34b are thus retained in fold-retaining slit 28 between upper edge 24c and lower edge 22b. Pin nubs 24d, protuberance 24e, notches 24f, fold-constricting region 26, and the lower edge of shirt button 32 provide traction to hold the necktie in place. Textured surface 30 provides traction to the wearer's fingers during manipulation of the tie holder as described above.

Once necktie 34 is in place, the rearward disposition of pin portion 24 from upper portion 22 provides a desirable rearward bias to the necktie folds, holding them against shirt 33. This feature is illustrated best in FIG. 7. FIG. 6 shows how the tie holder is hidden from view once it is in place.

Referring again to FIG. 9, tie hanger 35 is useful for hanging neckties on display in a store, as shown. When tie holder 20 is functioning as part of the tie hanger, necktie 34 is simply inserted at its midpoint into the fold-retaining slit. A useful aspect of this embodiment is that tie holder 20 may be easily broken away from hook section 36 by bending the tie holder relative to the hook section beyond the point of elasticity of joining nubs 36a. Hook section 36 may then be discarded and tie holder 20 sold with the necktie.

While particular embodiments of the invention have been discussed, it should be appreciated that modifications to these embodiments are possible without departing from the invention.

It is claimed and desired to secure by Letters Patent:

1. A tie holder for securing the depending folds of a four-in-hand necktie comprising, in operative position as attached to an upright wearer's shirt:

a generally vertically-disposed plate-like button-mounting upper portion having a lower edge and a button thread slit extending generally upwardly from said lower edge; and a pin portion disposed below said upper portion, having a proximal end joined to said upper portion, a distal end, and an upper edge disposed generally adjacently and spaced from said lower edge, said upper edge having a protuberance disposed generally opposite and extending toward the opening in said thread slit and said upper edge being of sufficient length to form, in combination with said lower edge, an elongate fold-retaining slit communicating with said thread slit.

2. The tie holder of claim 1, which further includes a stretch of surface having a traction-promoting texture.

3. The tie holder of claim 1, wherein said distal end is tapered.

4. The tie holder of claim 1, wherein said tie holder is constructed in such a manner that said thread slit and said fold-retaining slit cooperatively form a generally uniformly extending button thread guide slit.

5. The tie holder of claim 1, wherein said upper portion includes nub means extending into said thread slit and said thread slit further includes a thread-constricting throat.

6. The tie holder of claim 1, wherein said thread slit terminates in a thread-accommodating end and said upper portion further includes a generally circular recess centered around said thread-accommodating end.

7. The tie holder of claim 1, wherein said upper portion adjacent said distal end and said distal end are further constructed to form an outwardly-opening, generally lazy-V-shaped mouth communicating with said fold-retaining slit and the surfaces of said upper portion and said distal end adjacent the mouth are beveled such that the thicknesses of said upper portion and said distal end vary directly as the generally perpendicular distance from the mouth.

8. The tie holder of claim 1, wherein said upper portion is generally planar and said pin portion is disposed about a longitudinal axis generally parallel to the plane of said upper portion.

9. The tie holder of claim 8, wherein the axis is disposed rearwardly of the plane of said upper portion.

10. The tie holder of claim 1, wherein the surface of said pin portion includes fold-retension-enhancing nubs.

11. The tie holder of claim 10, wherein said nubs are disposed in a line on a rearwardly-facing surface stretch.

12. The tie holder of claim 1, wherein said upper edge and said lower edge are structured to form a fold-constricting first region in said fold-retaining slit, with said region-forming edges being relatively and resiliently displaceable.

13. The tie holder of claim 12, further including a surface stretch having fold-retension-enhancing notches disposed adjacently said first region.

14. The tie holder of claim 12, wherein said fold-retaining slit extends from the opening of said thread slit toward said distal end and said first region interposes the opening of said thread slit and said distal end.

15. The tie holder of claim 14, wherein said fold-retaining slit extends from the opening of said thread slit toward said proximal end and a fold-constricting second region interposes the opening of said thread slit and said proximal end.

16. A tie hanger for hanging four-in-hand neckties comprising:

a tie holder for securing the depending folds of a four-in-hand necktie comprising, in operative position as attached to an upright wearer's shirt, a generally vertically-disposed plate-like button-mounting upper portion having a lower edge and a button thread slit extending from said lower edge generally upwardly, and a pin portion disposed below said upper portion, having a proximal end joined to said upper portion, a distal end, and an upper edge disposed generally adjacently and spaced from said lower edge, said upper edge having a protuberance disposed generally opposite and extending toward the opening in said thread slit and said upper edge being of sufficient length to form, in combination with said lower edge, an elongate fold-retaining slit communicating with said thread slit; and hanger means, hangable from an external object, joined to and extending from said tie holder for suspending, when hung from an external object, said tie holder.

17. The tie hanger of claim 16, wherein the longitudinal axis of said fold-retaining slit extends generally horizontally when said tie hanger is hanging from an external object.

18. The tie hanger of claim 16, wherein said hanger means is detachably attached to said tie holder.

19. The tie hanger of claim 18, wherein said hanger means is generally plate-like and generally coplanar with said upper portion.

20. A tie holder for securing the depending folds of a four-in-hand necktie comprising, in operative position as attached to an upright wearer's shirt:

a generally vertically-disposed, plate-like and generally planar button-mounting upper portion having a lower edge, a button thread slit extending generally upwardly from said lower edge, nub means extending into said thread slit, said thread slit further including a thread-constricting throat and terminating in a thread-accommodating end, and said upper portion further including a generally circular recess centered around said thread-accommodating end;

a pin portion disposed about a longitudinal axis spaced rearwardly of and generally parallel to the plane of said upper portion, including a proximal end joined to said upper portion, a tapered distal end, an upper edge disposed generally adjacently and spaced from said lower edge, a surface stretch of fold-retension-enhancing nubs disposed in a line on the rearwardly-facing surface of said pin portion, said upper edge having a protuberance disposed generally opposite and extending toward the opening in said thread slit and said upper edge having sufficient length to form, in combination with said lower edge, an elongate fold-retaining slit communicating with said thread slit and extending from said thread slit toward said proximal end and said distal end, said thread slit and said fold-retaining slit cooperatively forming a generally uniformly extending button thread guide slit, said upper edge and said lower edge further being structured to form a pair of fold-constricting regions in said fold-retaining slit, with said region-forming edges being relatively and resiliently displaceable, a first region of said pair of regions interposing the opening of said thread slit and said distal end, a second region of said pair of regions interposing the opening of said thread slit and said proximal end, said first region having a surface stretch of fold-retension-enhancing notches, and said distal end and said upper portion adjacent said distal end are further constructed to form an outwardly-opening, generally lazy-V-shaped mouth communicating with said fold-retaining slit and the surfaces of said upper portion and said distal end adjacent the mouth being beveled such that the thicknesses of said upper portion and said distal end vary directly as the generally perpendicular distance from the mouth; and a stretch of surface having a traction-promoting texture.

* * * * *